US007249615B2

(12) United States Patent
Westerkamp et al.

(10) Patent No.: US 7,249,615 B2
(45) Date of Patent: Jul. 31, 2007

(54) PAPER MACHINE CLOTHING

(75) Inventors: Arved Westerkamp, Dettingen (DE); Johann Boeck, Neufelden (AT)

(73) Assignee: Voith Fabrics Patent GmbH, Heidenheim (DE)

( * ) Notice: Subject to any disclaimer, the term of this patent is extended or adjusted under 35 U.S.C. 154(b) by 0 days.

(21) Appl. No.: 11/185,703

(22) Filed: Jul. 21, 2005

(65) Prior Publication Data

US 2006/0016509 A1 Jan. 26, 2006

(30) Foreign Application Priority Data

Jul. 22, 2004 (DE) ..... 10 2004 035 522

(51) Int. Cl.

| | |
|---|---|
| ***D03D 3/04*** | (2006.01) |
| ***D21F 7/08*** | (2006.01) |
| *D03D 25/00* | (2006.01) |
| *D21F 7/10* | (2006.01) |

(52) U.S. Cl. ..... 139/383 A; 139/383 AA; 162/358.2

(58) Field of Classification Search ..... 139/383 A, 139/383 AA; 162/358.2

See application file for complete search history.

(56) References Cited

U.S. PATENT DOCUMENTS

| | | | | | |
|---|---|---|---|---|---|
| 4,815,499 | A | * | 3/1989 | Johnson | 139/383 A |
| 4,998,568 | A | * | 3/1991 | Vohringer | 139/383 A |
| 5,465,764 | A | * | 11/1995 | Eschmann et al. | 139/383 A |
| 5,544,678 | A | * | 8/1996 | Barrett | 139/383 A |
| 5,613,527 | A | * | 3/1997 | Zimmermann et al. | 139/383 A |
| 5,826,627 | A | * | 10/1998 | Seabrook et al. | 139/383 A |
| 5,829,489 | A | | 11/1998 | Kuji | |
| 5,988,229 | A | | 11/1999 | Quigley | |
| 6,123,116 | A | * | 9/2000 | Ward et al. | 139/383 A |
| 6,202,705 | B1 | * | 3/2001 | Johnson et al. | 139/383 A |
| 6,223,780 | B1 | * | 5/2001 | Kaldenhoff | 139/383 A |
| 6,240,973 | B1 | * | 6/2001 | Stone et al. | 139/383 A |
| 6,244,306 | B1 | * | 6/2001 | Troughton | 139/383 A |
| 6,334,467 | B1 | * | 1/2002 | Barrett et al. | 139/383 A |
| 6,354,335 | B1 | * | 3/2002 | Taipale et al. | 139/383 A |

FOREIGN PATENT DOCUMENTS

| | | |
|---|---|---|
| CA | 2297800 | 2/1999 |
| DE | 19732879 | 2/1999 |

* cited by examiner

*Primary Examiner*—Gary L. Welch
*Assistant Examiner*—Robert Muromoto
(74) *Attorney, Agent, or Firm*—Greenblum & Bernstein, P.L.C.

(57) ABSTRACT

Paper machine clothing, such as a forming fabric formed by a large number of repeating units, wherein each repeat unit includes a paper-side woven structure having paper-side warp and weft threads and a machine-side woven structure having machine-side warp and weft threads, such that the paper side and the machine side woven structures are connected to each other by binding threads, and each repeat unit being formed by at least 26 warp threads and the paper machine clothing having a total thickness of 0.78 mm and less.

21 Claims, 4 Drawing Sheets

PAPER MACHINE CLOTHING

CROSS-REFERENCE TO RELATED APPLICATIONS

The present application claims priority under 35 U.S.C. §119 of German Patent Application No. 10 2004 035 522.3, filed on Jul. 22, 2004, the disclosure of which is expressly incorporated by reference herein in its entirety.

BACKGROUND OF THE INVENTION

1. Field of the Invention

The present invention relates to paper machine clothing having a paper-side and a machine-side woven structure. In particular, the binding threads are woven while forming covering binding points with the paper-side woven structure and forming supporting binding points with the machine-side woven structure.

2. Discussion of Background Information

The invention relates to paper machine clothing having a paper-side and a machine-side woven structure. In order to meet the substantial requirements on paper machine clothing for use in the forming section of paper machines, i.e., forming fabrics, three-layer forming fabrics have increasingly been developed in recent years, which allows for an increase dimensional stability, along with reduction in the tendency to marking. The three-layer forming fabrics have a paper-side woven structure which is connected by binding threads to a machine-side woven structure. In particular, this type of fabric has binding threads woven with the paper-side woven structure, forming covering binding points, and with the machine-side woven structure, forming supporting binding points.

In this case, the conventionally weft-bound, three-layer fabrics with a separate binding thread system can no longer satisfy the requirements with respect to monoplanarity of the surface, as well as the requirements on the marking behavior.

For this reason, the pure binding threads were given an additional task, in that they were used as part of the paper-side woven structure. In particular, the binding threads continued the woven structure formed by the warp and weft threads. Thus, a fiber-supporting action is also added to the binding action of the binding threads. Such that, the forming fabrics are designated SSB fabrics, i.e., sheet support binder. In this manner, the tendency to marking on the paper side can be reduced considerably.

Despite the improvements described, the known forming fabrics continue to exhibit a high tendency to marking. The high tendency to marking is caused, inter alia, by covering binding points and supporting binding points of the binding threads on the paper-side and the machine-side woven structure, since, at these points, the planarity and the permeability of the fabric, and thus, the dewatering behavior of the fibrous suspension, are changed.

SUMMARY OF THE INVENTION

Paper machine clothing embodied according to the invention is characterized by a forming fabric having a binding thread system, which compared with the paper machine clothing known from the prior art, has a considerably less visible tendency to marking.

Paper machine clothing having a paper-side and a machine-side woven structure and having binding threads which are woven while forming covering binding points with the paper-side woven structure and forming supporting binding points with the machine-side woven structure. An arrangement of the covering binding points and of the supporting binding points may be by lining up a plurality of smallest covering binding point repeat units and supporting binding point repeat units in a row. Wherein, in each covering binding point repeat unit and/or supporting binding point repeat unit, at least one of the supporting binding points or covering binding points is arranged irregularly in relation to the other supporting binding points and covering binding points.

The paper machine clothing according to the invention is characterized by a paper-side and a machine-side woven structure, and the binding threads woven to form covering binding points with the paper-side woven structure and to form supporting binding points with the machine-side woven structure. Further, the arrangement of the covering binding points and the supporting binding points can be described by lining up a plurality of the smallest covering binding point repeat units and supporting binding point repeat units in a row. In each covering binding point repeat unit and/or supporting binding point repeat unit, at least one of the supporting binding points or covering binding points can be arranged irregularly in relation to the other supporting binding points and covering binding points.

According to the invention provides the covering binding points and supporting binding points are defined as, in the case of a covering binding point, a binding thread weaves over a paper-side MD/CD thread; and, in the case of a supporting binding point, the binding thread weaves under a machine-side MD/CD thread. No paper-side MD/CD thread over which the binding weaves is arranged between successive covering binding points and supporting binding points. Further, no machine-side MD/CD thread under which the binding thread weaves is arranged between successive covering binding points and supporting binding points.

The invention provides an irregular arrangement which means at least one of the supporting binding points or covering binding points breaks through the pattern formed by the other supporting binding points or covering binding points, or does not continue this pattern. For example, all the supporting binding points can be arranged along one of a plurality of mutually parallel straight lines, and one supporting binding points is not arranged on one of the straight lines.

If the supporting binding points and covering binding points are arranged regularly in relation to one another, it is possible to arrange these along mutually parallel straight lines. Thus, an irregular arrangement can be achieved by arranging some of the supporting binding points and/or covering binding points in the supporting binding point repeat unit or covering binding point repeat unit to be connected to one another only by at least one straight line does not run parallel to another straight line connecting the supporting binding points or covering binding points to one another.

According to the foregoing disclosure, in each supporting binding pot repeat unit and/or covering binding point repeat unit, at least some of the supporting binding points and covering binding points are arranged along a straight line which does not run parallel to the straight line(s) connecting the other supporting binding points or covering binding points to one another. In this way, the uniform structure of the arrangement of the supporting binding points and covering binding points may be interrupted, so as to reduce the tendency to marking.

The arrangement of the supporting binding points and covering binding points can be described by lining up many supporting binding point repeat units and covering binding point repeat units in a row. Trials have shown that the tendency to marking is particularly high if the straight lines connecting the supporting binding points and covering binding points to one another of a supporting binding point repeat unit or a covering binding point repeat unit, continue to the adjacent supporting binding point repeat unit or covering binding point repeat unit. As result, a regular arrangement of the supporting binding points and covering binding points from supporting binding point repeat unit or covering binding point repeat unit to an adjacent supporting binding point repeat unit or covering binding point repeat unit is continued in a straight extension.

An exemplary embodiment of the invention provides for the irregular arrangement of to some of the covering binding points and/or supporting binding points in the supporting binding point repeat unit or covering binding point repeat unit being arranged such that the covering binding points and/or supporting binding points in a first supporting binding point repeat unit or covering binding point repeat unit cannot be connected to one another by a straight line continued by connecting covering binding points or supporting binding points in a second supporting binding point repeat unit or covering binding point repeat unit adjoining the first supporting binding point repeat unit or covering binding point repeat unit.

Trials have further shown that not only the direct arrangement of supporting binding points or covering binding points along a straight line spreads over supporting binding point repeat units or covering binding point repeat units, can lead to an intensified tendency to marking. However, a parallel arrangement of the straight lines from supporting binding point repeat unit or covering binding point repeat unit to adjacent supporting binding point repeat unit or covering binding point repeat unit, intensifies the tendency to marking. For this reason, an exemplary embodiment of the invention provides for the irregular arrangement to be brought about by some of the covering binding points and/or supporting binding points in the supporting binding point repeat unit or covering binding point repeat unit being arranged such that the covering binding points and/or supporting binding points cannot be connected to one another by a straight line in a first supporting binding point repeat unit or covering binding point repeat unit that, runs parallel to a straight line and connects to another covering binding points or supporting binding points in a second supporting binding point repeat unit or covering binding point repeat unit adjoining the first supporting binding point repeat unit or covering binding point repeat unit.

The situation is reached where at least one straight line cannot be continued by a straight line parallel thereto in an adjacent supporting binding point repeat unit or covering binding point repeat unit. However, the straight line runs discontinuously, for example in a broken manner, in continuation of the supporting binding point repeat unit or covering binding point repeat unit. As a result the visibility of the marking is reduced considerably.

The present invention provides another possibility of influencing the regularity of the supporting binding points or covering binding points, which may includes in at least some supporting binding points or covering binding points arranged along a straight line, to be spaced apart differently from one another along the straight line.

The visibility of the marking can also be reduced further, such that the more supporting binding points or covering binding points arranged irregularly in the supporting binding point repeat unit or covering binding point repeat unit, the arrangement of the supporting binding points or covering binding points have to be coordinated with the paper-side and/or machine-side woven structure. A preferred embodiment of the invention provides for up to 20%, preferably up to 30%, particularly preferably up to 50% and quite particularly preferably up to 70% of the supporting binding points or covering binding points in the supporting binding point repeat unit or covering binding point repeat unit being arranged so as not to follow a regular pattern.

For example, a completely irregular arrangement of the supporting binding points or the covering binding points, results in the visibility of the marking to be reduced considerably.

The paper machine clothing can be described by lining up a plurality of the smallest repeat units in a line. In particular, the smallest repeat unit of the paper machine clothing is the smallest common multiple of the smallest repeat unit of the paper-side woven structure, e.g. the smallest repeat unit of the machine-side woven structure, the supporting binding point repeat unit and the covering binding point repeat unit. The possible variation in influencing the irregular arrangement of the supporting binding points and covering binding points can be increased considerably by increasing the number of warp threads in each smallest repeat unit. Accordingly, an embodiment of the invention provides for the smallest repeat unit of the paper machine clothing to be formed by 24 or 26 or 28 or 30 or 40 or more warp threads.

According to another embodiment of the invention, the supporting binding point repeat unit or covering binding point repeat unit can be formed by at most 5 or 7 warp threads.

Furthermore, it is possible for the binding threads to run in the warp and/or weft direction.

According to the invention, in order to reduce the tendency to marking further it is advantageous when, the binding threads are an integral constituent part of the paper-side woven pattern such that, by weaving the binding threads with the paper-side warp threads or with the paper-side weft threads, the woven pattern formed by the paper-side warp and weft threads is continued.

However, it is it is possible for the paper-side woven pattern to be formed only by weaving paper-side warp or weft threads with the binding threads.

According to another embodiment of the invention, the paper-side woven structure can be a basic weave or a derivative of the same in the textile sense. The basic weave is preferably a plain weave.

According to the invention, if the paper-side woven structure is formed by weaving the warp threads, weft threads, and binding threads, it may be advantageous when the binding threads are in each case arranged as pairs of binding threads, such that, e.g., each pair of the binding threads on the paper side weaves the path of a non-binding weft or warp thread.

The paper machine clothing may be a forming fabric. The forming fabric according to the invention is preferably used for the production of graphic papers, because of its reduced visibility of the marking.

The invention is directed to a paper machine clothing including a paper side woven structure and a machine side woven structure having a plurality of binding threads woven to form of a plurality of covering binding points with the paper side woven structure, and to form a plurality of supporting binding points with the machine side woven structure. Further, the covering binding points and the supporting binding points can be arranged by lining up a plurality of covering binding point repeat units and a plurality of supporting binding point repeat units in a row. Further still, in at least one of each covering binding point repeat unit and each supporting binding point repeat unit, at least one of the supporting binding points and the covering binding points are irregularly arranged in relation to the other supporting binding points and covering binding points.

According to another feature of the invention the irregular arrangement is arranged at least partially by at least one of the supporting binding points and covering binding points in the supporting binding point repeat unit or covering binding point repeat unit. Further, the at least one of the supporting binding points and covering binding points are connected to one another only by at least one straight line which does not run parallel to another straight line connecting supporting binding points and/or covering binding points to one another.

According to another feature of the invention the irregular arrangement is arranged at least partially by at least one of the supporting binding points and covering binding points in the supporting binding point repeat unit or covering binding point repeat unit. Further, at least one of the supporting binding points and covering binding points in a first supporting binding point repeat unit or a first covering binding point repeat unit cannot be connected to one another by a straight line which is continued by connecting the covering binding points or supporting binding points in a second supporting binding point repeat unit or a second covering binding point repeat unit adjoining the first supporting binding point repeat unit or first covering binding point repeat unit.

According to another feature of the invention the irregular arrangement is arranged at least partially by at least one of the supporting binding points and covering binding points in the supporting binding point repeat unit or covering binding point repeat unit. Further, at least one of the supporting binding points and/or covering binding points cannot be connected to one another by a straight line in a first supporting binding point repeat unit or a first covering binding point repeat unit which runs parallel to a straight line which connects to one another covering binding points and/or supporting binding points in a second supporting binding point repeat unit or a second covering binding point repeat unit adjoining the first supporting binding point repeat unit or the first supporting covering binding point repeat unit.

According to another feature of the invention at least a portion of the supporting binding points or covering binding points are arranged along a straight line spaced apart differently from one another along the straight line.

According to another feature of the invention up to one of 20%, 30%, 50% and 70% of at least one of the supporting binding points and the covering binding points in the supporting binding point repeat unit or covering binding point repeat unit are arranged so as not to follow a regular pattern.

According to another feature of the invention the smallest repeat unit of the paper machine clothing is formed by at least one of 24, 26, 28, 30 and 40 warp threads.

According to another feature of the invention the supporting binding point repeat unit or covering binding point repeat unit is formed by one of at most 5 and at most 7 warp threads.

According to another feature of the invention the binding threads run in at least one of a warp and a weft direction. Further, the weaving of the binding threads with the paper-side warp threads or with the paper-side weft threads results in a woven pattern formed by the paper-side warp and weft threads that is continued. Further still, the paper-side woven structure is one of a basic weave, a derivative of the same and a plain weave.

According to another feature of the invention the binding threads are arranged as pairs of binding threads. Further, the paper machine clothing may be structured as a forming fabric. Further still, the paper machine clothing may be structured as a forming fabric for the production of graphic papers.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1:
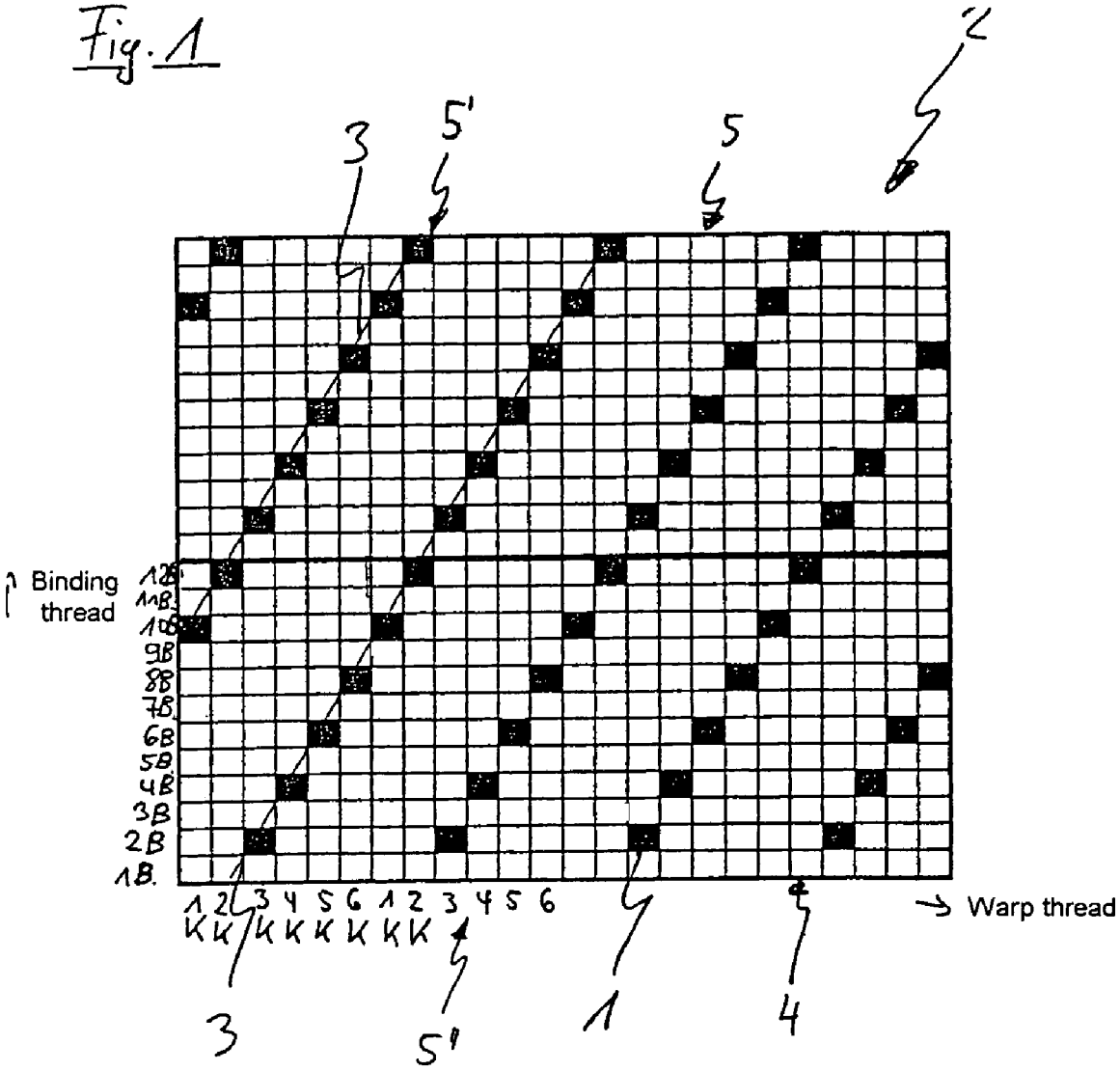
FIG. 1 A plan view of the distribution of supporting binding points on the machine side of a woven structure having a smallest supporting binding point repeat unit formed by 6 warp threads, FIG. 2 A plan view of an irregular distribution of supporting binding points on the machine side in a forming fabric according to the invention, having a smallest supporting binding point repeat unit with 30 warp threads, FIG. 3 A plan view of a virtually completely irregular distribution of supporting binding points on the machine side in a forming fabric according to the invention having a smallest supporting binding point repeat unit with 30 warp threads, FIG. 4 A plan view of an irregular distribution of supporting binding points on the machine side in a forming fabric according to the invention having a smallest supporting binding point repeat unit with 5 warp threads.

FIG. 1 illustrates distribution of supporting binding points 1 of the binding threads of a forming fabric 2 having a supporting binding point repeat unit formed by six warp threads 1K to 6K and twelve binding threads 1B to 12B running in the weft direction. The supporting binding points 1 are represented by black squares in the illustration of FIG. 1.

As can be seen from FIG. 1, the supporting binding points 1 are arranged regularly in relation to one another, which means that these can be connected to one another by a plurality of mutually parallel straight lines 3. The supporting binding points 1 in the forming fabric 2 of FIG. 1 are arranged in such a way that the straight lines 3 connecting the supporting binding points 1 to one another can be continued by a supporting binding point repeat unit 4 in the adjacent repeat units 5, 5', 5". The distribution of the supporting binding points 1 thus exhibits a strong diagonal formation. This distribution leads to a change in the pore structure in the regions of the supporting binding, which consequently leads to quality-diminishing markings in the paper, particularly in the graphic paper sector.

Figure 2:
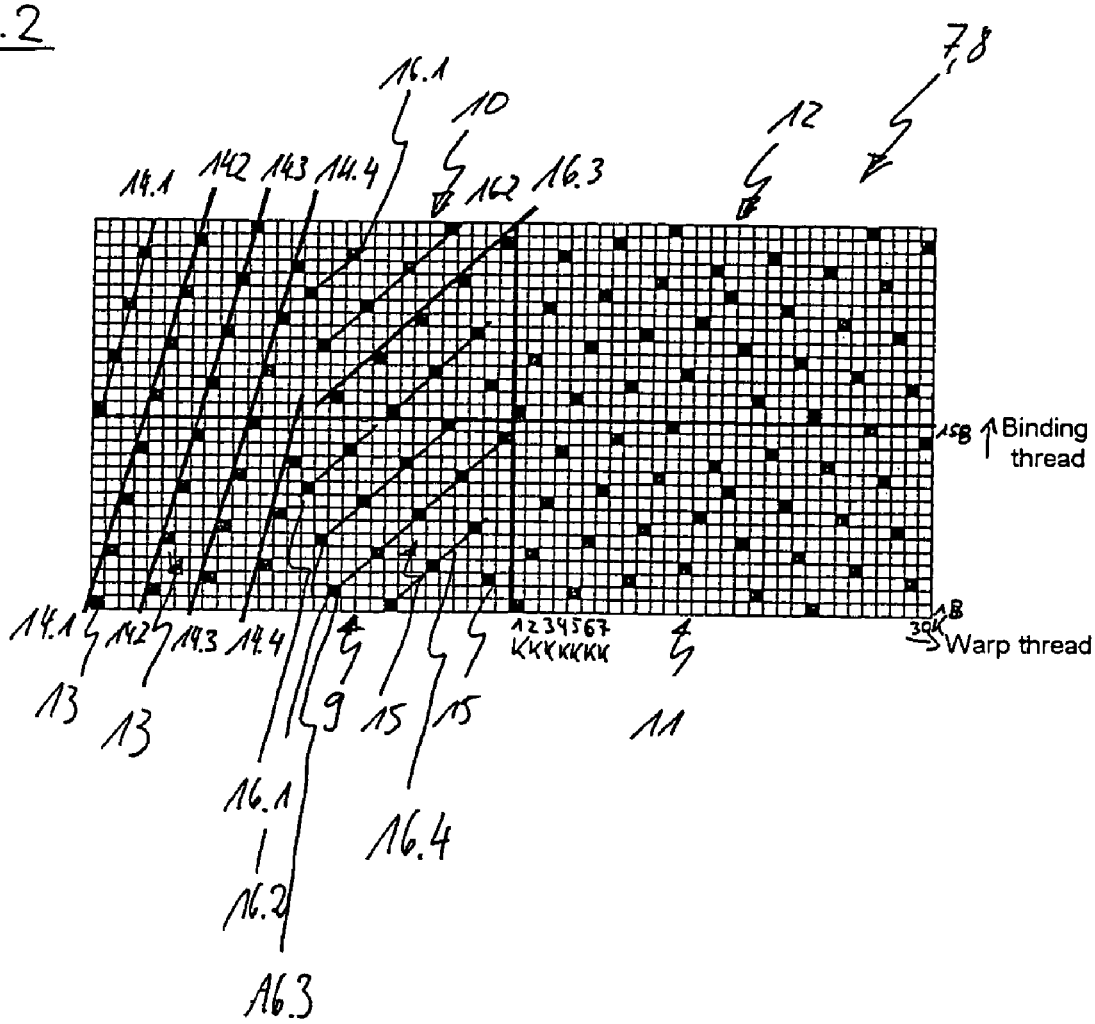

FIG. 2 shows a distribution of the supporting binding points on the machine side 7 of a forming fabric 8 according to the invention. A smallest supporting binding point repeat unit of the forming fabric 8 illustrated is formed by 30 warp threads 1K to 30K and by 15 binding threads 1B to 15B running in the weft direction. As can be seen from FIG. 2, four smallest supporting binding point repeat units 9 to 12 adjoining one another are illustrated.

Each supporting binding point repeat unit 9 to 12 has in the left-hand region a number of supporting binding points 13 arranged regularly in relation to one another, which are connected to one another via mutually parallel straight lines 14.1 to 14.4. These straight lines may, to some extent, be continued in the adjacent repeat units. For example, the straight line 14.1 of the repeat unit 9 is continued by the straight line 14.2 of the repeat unit 10; or else the straight line 14.2 from the repeat unit 9 is continued by the straight line 14.3 of the repeat unit 10. In the right-hand region of each smallest supporting binding point repeat unit 9 to 12, a number of supporting binding points 15 are arranged regularly in relation to one another, but are arranged irregularly in relation to the supporting binding points 13, i.e., the pattern formed by the supporting binding points 13 is not continued. Accordingly, in each supporting binding point repeat unit 9 to 12, the supporting binding points 15 are arranged irregularly in relation to the supporting binding points 13.

Moreover, the irregular arrangement is brought about by the supporting binding points 15 in each supporting binding point repeat unit, when connected to one another only by straight lines 16.1 to 16.4, which do not run parallel to the straight lines 14.1 to 14.4 connecting the supporting binding points 13 to one another.

Furthermore, the irregular arrangement is brought about by some of the supporting binding points 15. For example, in the supporting binding point repeat unit 9 can be structured such that the supporting binding points 15 cannot be connected to one another by a straight line, that can be continued by connecting supporting binding points 13 or 15 in a supporting binding point repeat unit 10 or 11 or 12 adjoining the supporting binding point repeat unit 9.

Instead, e.g., when the supporting binding point repeat units are continued, the straight line 14.4 of the supporting binding point repeat unit 9 is broken by the straight line 16.2 of the supporting binding point repeat unit 10. Thus, the straight lines 14.4 and 16.2 run discontinuously (in a broken manner) from the supporting binding point repeat unit 9 to the supporting binding point repeat unit 10. Furthermore, the straight lines 16.3 and 16.4 are broken, i.e., not continued continuously, when the supporting binding point repeat units 11 and 12 are continued. This reduces substantially the visibility of the marking arising as a result of the binding thread supporting binding points.

Figure 3:
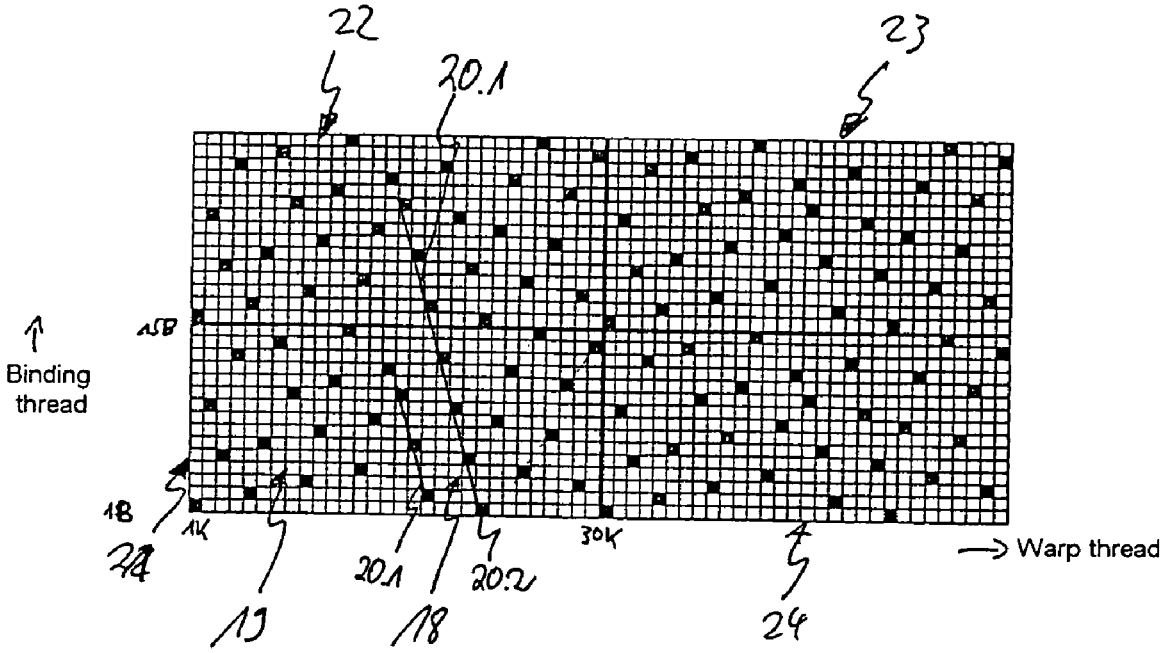

FIG. 3 shows a further embodiment of the invention in the form of a forming fabric 17 having a virtually free distribution of its supporting binding points 18 and 19. Each supporting binding point repeat unit 21 to 24 is formed by 30 warp threads 1K to 30K and 15 binding threads 1B to 15B running in the weft direction. Only the supporting binding points 18 are arranged in relation to one another such that these can be connected to one another by mutually parallel straight lines 20.1 and 20.2. Furthermore, it can be seen that the straight line 20.2 of the supporting binding point repeat unit 21 is continued in the straight line 20.1 of the repeat unit 22.

Figure 4:
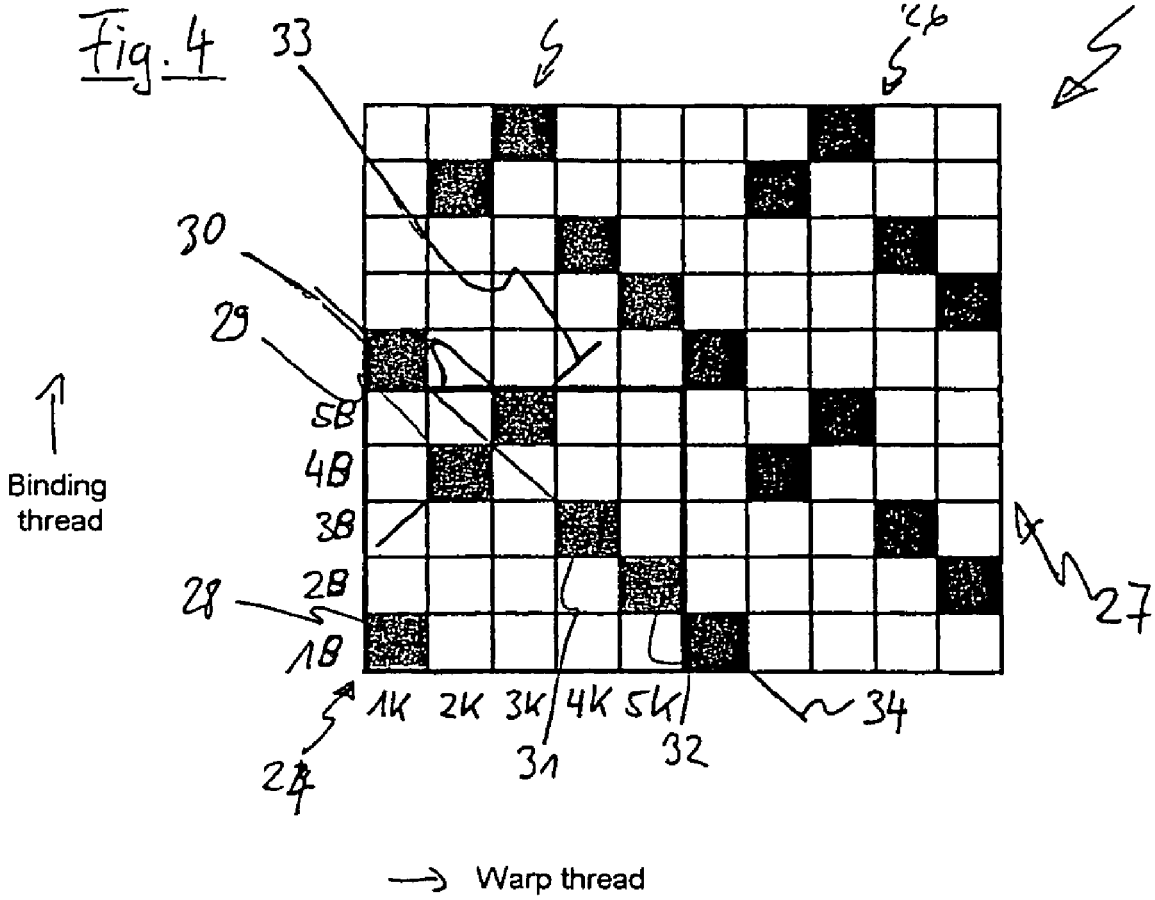

FIG. 4 shows a further embodiment of the invention in the form of the supporting point distribution of a forming fabric 23. The arrangement of the supporting binding points 28 to 32 can be described by one of the supporting binding point repeat units 24 to 27. Such that, each supporting binding point repeat unit 24 to 27 can be formed by five warp threads 1K to 5K and five binding threads 1B to 5B running in the weft direction.

FIG. 4 shows in each supporting binding point repeat unit 24 to 27, the support binding points 29 and 30 arranged irregularly in relation to the remaining supporting binding points 28, 31 and 32. Thus, the pattern formed by the supporting binding points 28, 31 and 32 is not continued by the supporting binding points 29 and 30.

Moreover, an irregular arrangement is brought about by the supporting binding points 29 and 30 in the supporting binding point repeat unit being arranged in such a way that these can be connected to one another only by a straight line 33, which does not run parallel to a straight line 34 connecting the supporting binding points 28, 31 and 32 to one another.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

The invention claimed is:

1. A paper machine clothing comprising:

a paper side woven structure and a machine side woven structure;

a plurality of binding threads woven to form of a plurality of covering binding points with the paper side woven structure, and to form a plurality of supporting binding points with the machine side woven structure; and the covering binding points and the supporting binding points being arranged by lining up a plurality of covering binding point repeat units and a plurality of supporting binding point repeat units in a row, wherein in at least one of each covering binding point repeat unit and each supporting binding point repeat unit, at least one of the supporting binding points and the covering binding points are irregularly arranged in relation to the other supporting binding points and covering binding points, and wherein the at least one of the supporting binding points and covering binding points in a first supporting binding point repeat unit or a first covering binding point repeat unit cannot be connected to one another by a straight line which is continued by connecting the covering binding points or supporting binding points in a second supporting binding point repeat unit or a second covering binding point repeat unit adjoining the first supporting binding point repeat unit or first covering binding point repeat unit.

2. A paper machine clothing comprising:

a paper side woven structure and a machine side woven structure;

a plurality of binding threads woven to form of a plurality of covering binding points with the paper side woven structure, and to form a plurality of supporting binding points with the machine side woven structure; and the covering binding points and the supporting binding points being arranged by lining up a plurality of covering binding point repeat units and a plurality of supporting binding point repeat units in a row, wherein in at least one of each covering binding point repeat unit and each supporting binding point repeat unit, at least one of the supporting binding points and the covering binding points are irregularly arranged in relation to the other supporting binding points and covering binding points, wherein the irregular arrangement is arranged at least partially by at least one of the supporting binding points and covering binding points in the supporting binding point repeat unit or covering binding point repeat unit;

wherein the at least one of the supporting binding points and covering binding points are connected to one another only by at least one straight line which does not run parallel to another straight line connecting supporting binding points and/or covering binding points to one another.

3. A paper machine clothing according to claim 1, wherein the irregular arrangement is arranged at least partially by at least one of the supporting binding points and covering binding points in the supporting binding point repeat unit or covering binding point repeat unit.

4. A paper machine clothing comprising:

a paper side woven structure and a machine side woven structure;

a plurality of binding threads woven to form of a plurality of covering binding points with the paper side woven structure, and to form a plurality of supporting binding points with the machine side woven structure; and the covering binding points and the supporting binding points being arranged by lining up a plurality of covering binding point repeat units and a plurality of supporting binding point repeat units in a row, wherein in at least one of each covering binding point repeat unit and each supporting binding point repeat unit, at least one of the supporting binding points and the covering binding points are irregularly arranged in relation to the other supporting binding points and covering binding points, wherein the irregular arrangement is arranged at least partially by at least one of the supporting binding points and covering binding points in the supporting binding point repeat unit or covering binding point repeat unit;

wherein the at least one of the supporting binding points and/or covering binding points cannot be connected to one another by a straight line in a first supporting binding point repeat unit or a first covering binding point repeat unit which runs parallel to a straight line which connects to one another covering binding points and/or supporting binding points in a second supporting binding point repeat unit or a second covering binding point repeat unit adjoining the first supporting binding point repeat unit or the first supporting covering binding point repeat unit.

5. A paper machine clothing according to claim 1, wherein at least a portion of the supporting binding points or covering binding points are arranged along a straight line spaced apart differently from one another along the straight line.

6. A paper machine clothing according to claim 1, wherein up to 20% of at least one of the supporting binding points and the covering binding points in the supporting binding point repeat unit or covering binding point repeat unit are arranged so as not to follow a regular pattern.

7. A paper machine clothing according to claim 1, wherein up to 30% of at least one of the supporting binding points and the covering binding points in the supporting binding point repeat unit or covering binding point repeat unit are arranged so as not to follow a regular pattern.

8. A paper machine clothing according to claim 1, wherein up to 50% of at least one of the supporting binding points and the covering binding points in the supporting binding point repeat unit or covering binding point repeat unit are arranged so as not to follow a regular pattern.

9. A paper machine clothing according to claim 1, wherein up to 70% of at least one of the supporting binding points and the covering binding points in the supporting binding point repeat unit or covering binding point repeat unit are arranged so as not to follow a regular pattern.

10. A paper machine clothing according to claim 1, wherein the smallest repeat unit of the paper machine clothing is formed by at least 24 warp threads.

11. A paper machine clothing according to claim 1, wherein the smallest repeat unit of the paper machine clothing is formed by at least 26 warp threads.

12. A paper machine clothing according to claim 1, wherein the smallest repeat unit of the paper machine clothing is formed by at least 28 warp threads.

13. A paper machine clothing according to claim 1, wherein the smallest repeat unit of the paper machine clothing is formed by at least 30 warp threads.

14. A paper machine clothing according to claim 1, wherein the smallest repeat unit of the paper machine clothing is formed by at least 40 warp threads.

15. A paper machine clothing according to claim 1, wherein the supporting binding point repeat unit or covering binding point repeat unit is formed by one of at most 5 and at most 7 warp threads.

16. A paper machine clothing according to claim 1, wherein the binding threads run in at least one of a warp and a weft direction.

17. A paper machine clothing according to claim 1, wherein weaving of the binding threads with the paper-side warp threads or with the paper-side weft threads results in a woven pattern formed by the paper-side warp and weft threads that is continued.

18. A paper machine clothing according to claim 1, wherein the paper-side woven structure is one of a basic weave, a derivative of the same and a plain weave.

19. A paper machine clothing according to claim 1, wherein the binding threads are arranged as pairs of binding threads.

20. A paper machine clothing according to claim 1 structured as a forming fabric.

21. A paper machine clothing according to claim 1 structured as a forming fabric for the production of graphic papers.

* * * * *